US007283769B2

(12) United States Patent
Noh

(10) Patent No.: US 7,283,769 B2
(45) Date of Patent: Oct. 16, 2007

(54) DETACHABLE DEVELOPING APPARATUS AND DRIVING APPARATUS OF THE SAME

(75) Inventor: Joo-hwan Noh, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/048,814

(22) Filed: Feb. 3, 2005

(65) Prior Publication Data

US 2005/0169670 A1 Aug. 4, 2005

(30) Foreign Application Priority Data

Feb. 3, 2004 (KR) ..... 10-2004-0006972

(51) Int. Cl.
*G03G 15/00* (2006.01)

(52) U.S. Cl. ..... 399/167; 399/262; 399/279

(58) Field of Classification Search ..... 399/167, 399/119, 116, 262, 279, 36, 223, 222; 74/664, 74/665 R, 665 F, 665 GA, 393, 63
See application file for complete search history.

(56) References Cited

U.S. PATENT DOCUMENTS

| | | | | |
|---|---|---|---|---|
| 5,583,630 | A * | 12/1996 | Kimura et al. | 399/227 |
| 5,937,241 | A * | 8/1999 | Kumar et al. | 399/111 |
| 5,993,101 | A * | 11/1999 | Kohno et al. | 399/116 |
| 6,463,234 | B2 * | 10/2002 | Arimitsu et al. | 399/113 |
| 2001/0022902 | A1 * | 9/2001 | Nittani et al. | 399/167 |
| 2002/0172531 | A1 * | 11/2002 | Harada et al. | 399/167 |
| 2003/0081966 | A1 * | 5/2003 | Wakamatsu et al. | |
| 2004/0013446 | A1 * | 1/2004 | Morioka et al. | |

FOREIGN PATENT DOCUMENTS

| | | | |
|---|---|---|---|
| JP | 63-237068 | | 10/1988 |
| JP | 05-265271 | | 10/1993 |
| JP | 08-234643 | | 9/1996 |
| JP | 2003-021942 | | 1/2003 |
| KR | 95011877 | B1 | 10/1995 |
| KR | 100320232 | B1 | 12/2001 |
| KR | 1020030020021 | A | 3/2003 |
| KR | 1020030043141 | A | 6/2003 |

OTHER PUBLICATIONS

Chinese Search Report, mailed Apr. 6, 2007 and issued in corresponding Chinese Patent Application No. 200510006234.8.

* cited by examiner

*Primary Examiner*—David M. Gray
*Assistant Examiner*—Laura K Roth
(74) *Attorney, Agent, or Firm*—Staas & Halsey LLP

(57) ABSTRACT

A driving apparatus of a detachable developing apparatus, and the detachable developing apparatus using the driving apparatus. The driving apparatus includes: a coupling member including a coupling drive which is connected to a driving element and to which driving power is transferred from the driving element, a coupling gear to which driving power is transferred from the coupling drive, and a coupling disc positioned between the coupling drive and the coupling gear for flexibly connecting the coupling drive and the coupling gear; and a power transferring portion including a plurality of gears to transfer driving power from the coupling member to the developing element and the toner supply element. At least one of the plurality of gears is a reduction gear for reducing a load applied to the coupling member from the developing element and the toner supply element.

18 Claims, 6 Drawing Sheets

DETACHABLE DEVELOPING APPARATUS AND DRIVING APPARATUS OF THE SAME

CROSS-REFERENCE TO RELATED APPLICATIONS

This application claims the benefit of Korean Patent Application No. 2004-6972, filed on Feb. 3, 2004, in the Korean Intellectual Property Office, the disclosure of which is incorporated herein in its entirety by reference.

BACKGROUND OF THE INVENTION

1. Field of the Invention

The present invention relates to a driving apparatus of a developing apparatus of a laser printer, copier, or the like, and a developing apparatus using the driving apparatus, and more particularly, to a driving apparatus of a detachable developing apparatus capable of enhancing quality of a printed image by inducing uniform rotation and dampening of vibration even when a photosensitive unit and a developing unit are separately driven, and the detachable developing apparatus using the driving apparatus.

2. Description of the Related Art

In a laser printer, copier, combined printer, or the like, a developing apparatus for printing a processed image on a recording sheet is provided in the shape of a cartridge. In a related art, a photosensitive unit, the surface of which is scanned by a laser so that an electrostatic latent image can be formed on the surface thereof, and a developing unit for supplying toner to the photosensitive unit so that a toner image corresponding to the electrostatic latent image can be formed, are installed together in one cartridge. However, when the photosensitive unit and the developing unit are combined in one cartridge as above-mentioned, there is a problem in which even though the usable life of the photosensitive unit is generally much longer than that of the developing unit, the photosensitive unit must be replaced together with the developing unit when the developing unit reaches the end of its usable life, even if the photosensitive unit operates normally.

In order to solve this problem, as shown in FIG. 1, a structure in which a photosensitive unit 110 and a developing unit 120 are separated and driven separately was proposed. According to such a structure, the photosensitive unit 110 and the developing unit 120 are separately installed at a main body of a printer, copier, or the like, and are driven separately by separate gears. At this time, when the developing unit 120 is pressed toward the photosensitive unit 110 by a force of a spring, or the like with the photosensitive unit 110 fixed to the main body, a photosensitive drum 111 of the photosensitive unit 110 and a developing roller 121 of the developing unit 120 come into contact with each other, and slidably rotate together in their respective directions.

A structure and operation of such a detachable developing apparatus shown in FIG. 1 will be described in detail as follows.

First, a driving force to the photosensitive unit 110 is transferred from a photosensitive drum driving gear 113 to a photosensitive drum gear 112 which forms an image on a recording medium, such as a paper 200. Accordingly, when the photosensitive drum gear 112 rotates, the photosensitive drum 111 joined to the photosensitive drum gear 112 also rotates. On the other hand, a driving force to the developing unit 120 is transferred to the developing roller 121 first, and while a first idle gear 125 rotates according to the rotation of the developing roller 121, a portion of the driving force is transferred to a supply gear 126, and a toner supply roller 122 rotates. In addition, the other portion of the driving force is transferred to an agitator gear 128 via the first idle gear 125 and a second idle gear 127. When the agitator gear 128 rotates, an agitator 123 joined to the agitator gear 128 also rotates, and, accordingly, toner is moved by the agitator 123 toward the toner supply roller 122. Power transfer of the photosensitive unit 110 and the developing unit 120 are done separately, and therefore all the loads applied to respective gears are reduced.

However, when the photosensitive unit 110 and the developing unit 120 are driven separately from each other, there is possibility that a contacting nip depth or width between the photosensitive drum 111 and the developing roller 121 may be uneven. In order to prevent this problem, when the developing unit 120 is pressed by the force of the spring after the developing unit 120 is completely installed at the main body, the axis of the rotating shaft of the developing roller 121 and the axis of the driving shaft of a driving gear 140 supported by the main body must be precisely aligned with each other. However, at least some eccentricity will occur due to tolerance or the like occurring during manufacturing and assembling processes. Therefore, when the driving gear 140 (see FIG. 2) is directly connected to the shaft of the developing roller 121, eccentricity always occurs at the axis between the developing roller 121 and the driving gear 140. When the eccentricity occurs in this manner, the shaft of the developing roller 121 suffers vibrations during the rotation of the developing roller 121. The nip depth between the photosensitive drum 111 and the developing roller 121 is thus uneven, resulting in unstable development nips. Usually, the development nip depth is maintained in the range of about 0.05~1.15 mm in a nonmagnetic one-component contact development method, and when the development nip depth is greater than the range values, excessive pressure causes toner stress to occur. When the development nip depth is smaller than the range values, the development nip is not formed, and therefore image formation is not possible.

Therefore, as shown in FIGS. 2 and 3, a coupling member 130 is interposed between the developing roller 121 and the driving gear 140 so that the developing roller 121 can stably rotate even when an eccentricity occurs between the developing roller 121 and the driving gear 140 connected to the developing roller 121 to be aligned with the rotation axis of the developing roller 121, and the nip depth between the photosensitive drum 111 and the developing roller 121 can be maintained to be constant. Generally, a method of using the coupling member 130 having a shape shown in FIGS. 2 and 3 is known as the Oldham's coupling method. The Oldham's coupling is a mechanism usually used to smoothly transmit power even when eccentricity occurs between shafts.

As previously described, the driving force to the developing unit 120 is transferred to the developing roller 121 first via the driving gear 140 and the coupling member 130, and, thereafter, is transferred to the toner supply roller 122 and the agitator 123 via the idle gears 125 and 127. However, as shown in FIG. 4, the driving force of a motor pinion gear 160 which rotates at high speed is transferred to the driving gear 140 via a reduction gear 150. That is, speed reduction is performed before the driving force reaches the driving gear 140, and only after the speed reduction is completed is the driving force transferred to the developing unit 120 and the coupling member 130. As shown in FIG. 4, there is no speed reduction between the developing unit 120, the coupling member 130, and the driving gear 140. Therefore, in the conventional art, the load of the developing unit 120 is transferred to the coupling member 130 and the driving gear 140 without being changed. When the unchanged load of the developing unit 120 is transferred to the coupling member 130 and the driving gear 140, an excessive load may be applied to the coupling member 130 and the driving gear 140. Then, friction increases at four sliding slots 138 formed at right angles with one another at the outer circumferential surface of a coupling disc 132 positioned between a coupling gear 131 of the coupling member 130 and a coupling drive 134. Accordingly, since smooth sliding movement of the coupling disc 132 is prevented a problem occurs in which a principal function of the Oldham's coupling is lost.

Therefore, in the conventional art, in order to minimize frictional loads at the four sliding slots 138 formed at right angles with one another at the outer circumferential surface of the coupling disc 132, two pairs of rotation shafts 136 are installed at respective surfaces of the coupling gear 131 and the coupling drive 134 which face the coupling disc 132 to project from the respective surfaces, and to make an angle of 180° with each other on the respective surfaces. Also, sliding rollers 133 are fitted around the respective rotation shafts 136 so as to rotate in the sliding slots 138. Consequently, the structure of the coupling member becomes very complex due to the installation of such sliding rollers 133, and the cost thereof increases due to the installation of the rotation shafts 136 and the sliding rollers 133.

SUMMARY OF THE INVENTION

Accordingly, it is an aspect of the present invention to minimize friction occurring at sliding slots of a coupling disc by reducing a load applied to a coupling member or a driving gear which transfers driving power to a developing unit.

It is also an aspect of the present invention to maintain a nip depth between a photosensitive drum and a developing roller and enhance quality of a printed image by minimizing friction occurring at the sliding slots of the coupling disc and thereby causing the principal function of an Oldham's coupling, i.e., the function of correcting eccentricity occurring at a connected shaft to function smoothly.

It is also an aspect of the present invention to reduce cost by simplifying the structure of a coupling member.

Additional aspects and/or advantages of the invention will be set forth in part in the description which follows and, in part, will be obvious from the description, or may be learned by practice of the invention.

Accordingly, to achieve the above and/or other aspects, there is provided a driving apparatus of a detachable developing apparatus to transfer driving power of a driving element of the developing apparatus to a developing element including a shaft and a toner supply element including: a coupling member including a coupling drive which is connected to the driving element and to which the driving power is transferred from the driving element, a coupling gear to which the driving power is transferred from the coupling drive, and a coupling disc positioned between the coupling drive and the coupling gear to flexibly connect the coupling drive and the coupling gear to each other, and correct an eccentricity of the shaft between the driving element and the coupling gear; and a power transferring portion including a plurality of gears so as to transfer the driving power from the coupling member to the developing element.

In addition, to achieve the above and/other aspects, there is provided a developing unit of a detachable developing apparatus in which a photosensitive unit for transferring an electrostatic latent image formed by being exposed to a laser beam and the developing unit for forming a toner image by supplying toner to the photosensitive unit are separated from each other including: a driving element for transferring driving power to the developing unit; a developing element for forming a toner image by supplying toner to the photosensitive unit; a toner supply element for supplying toner to the developing element; a coupling member including a coupling drive which is connected to the driving element and to which driving power is transferred from the driving element, a coupling gear to which driving power is transferred from the coupling drive, and a coupling disc positioned between the coupling drive and the coupling gear for flexibly connecting the coupling drive and the coupling gear to each other, and capable of correcting eccentricity of the shaft between the driving element and the coupling gear; and a power transferring portion including a plurality of gears so as to transfer driving power from the coupling member to the developing element.

Furthermore, the foregoing and/or other aspects are achieved by providing a driving apparatus of a developing apparatus to transfer a driving power of a driving element of the developing apparatus to a developing element of the developing apparatus including a shaft, including: a coupling member which is connected to the driving element and to which the driving power is transferred from the driving element, and correcting an eccentricity of the shaft between the driving element and the coupling member; and a power transferring portion including a plurality of gears so as to transfer the driving power from the coupling member to the developing element, wherein at least one of the plurality of gears is a reduction gear to reduce a load applied to the coupling member from the developing element.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE PREFERRED EMBODIMENT

Figure 1:
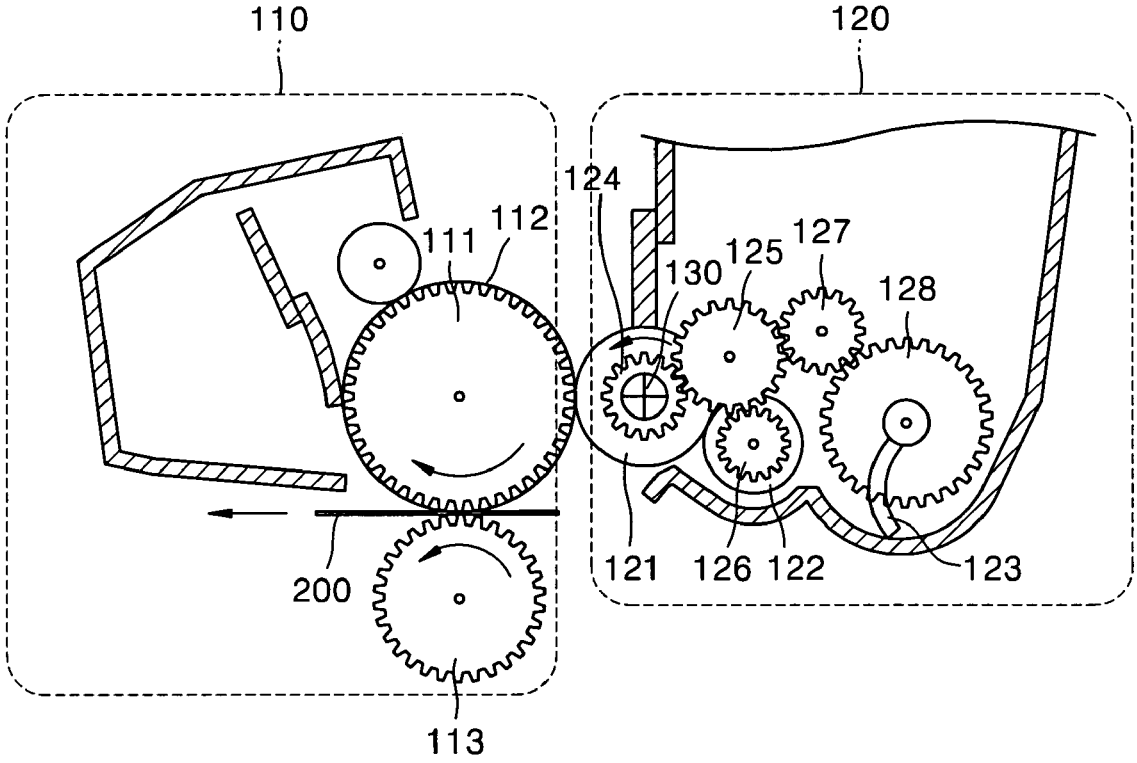
FIG. 1 (PRIOR ART)
FIG. 1 is a diagram schematically illustrating a structure of a conventional detachable developing apparatus.
Figure 2:
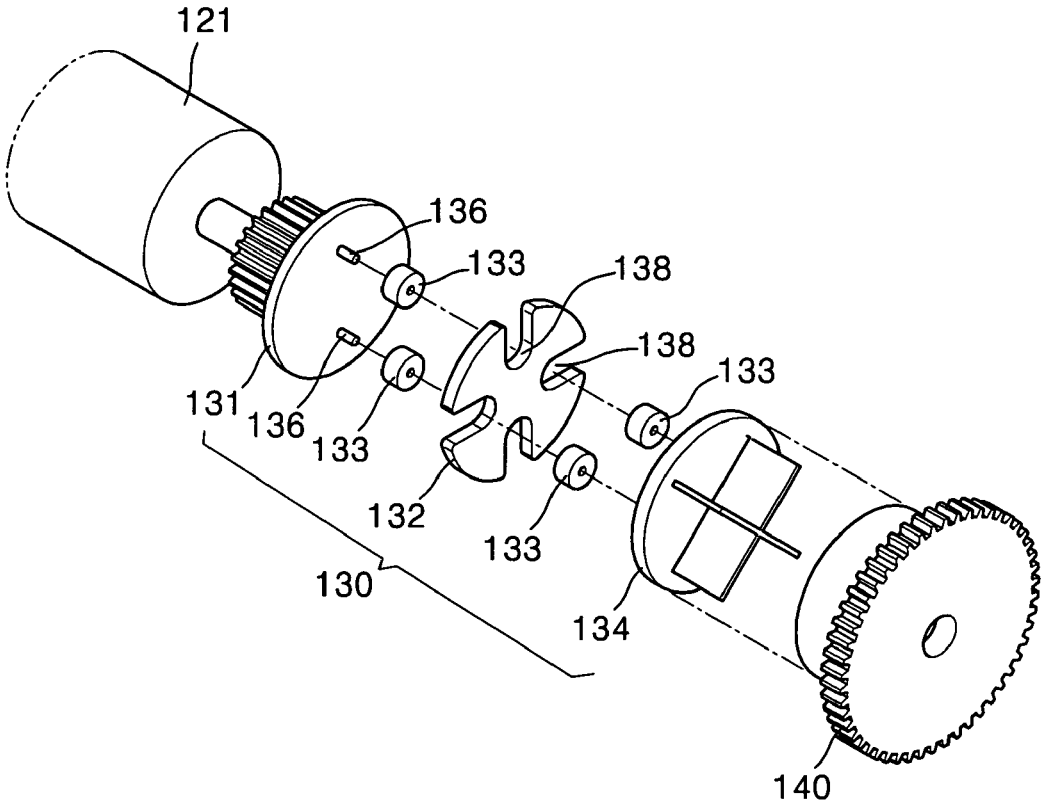
FIG. 2 (PRIOR ART)
FIG. 2 is an exploded perspective view schematically illustrating a structure of a conventional coupling member.
Figure 3:
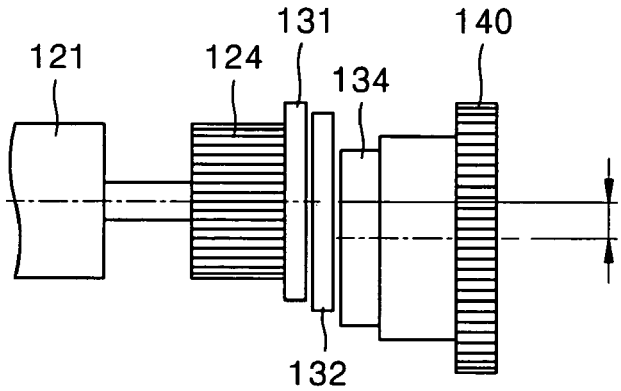
FIG. 3 (PRIOR ART)
FIG. 3 is a diagram exemplarily illustrating a state in which eccentricity occurs between the shafts of a developing roller and a driving gear according to the conventional art.
Figure 4:
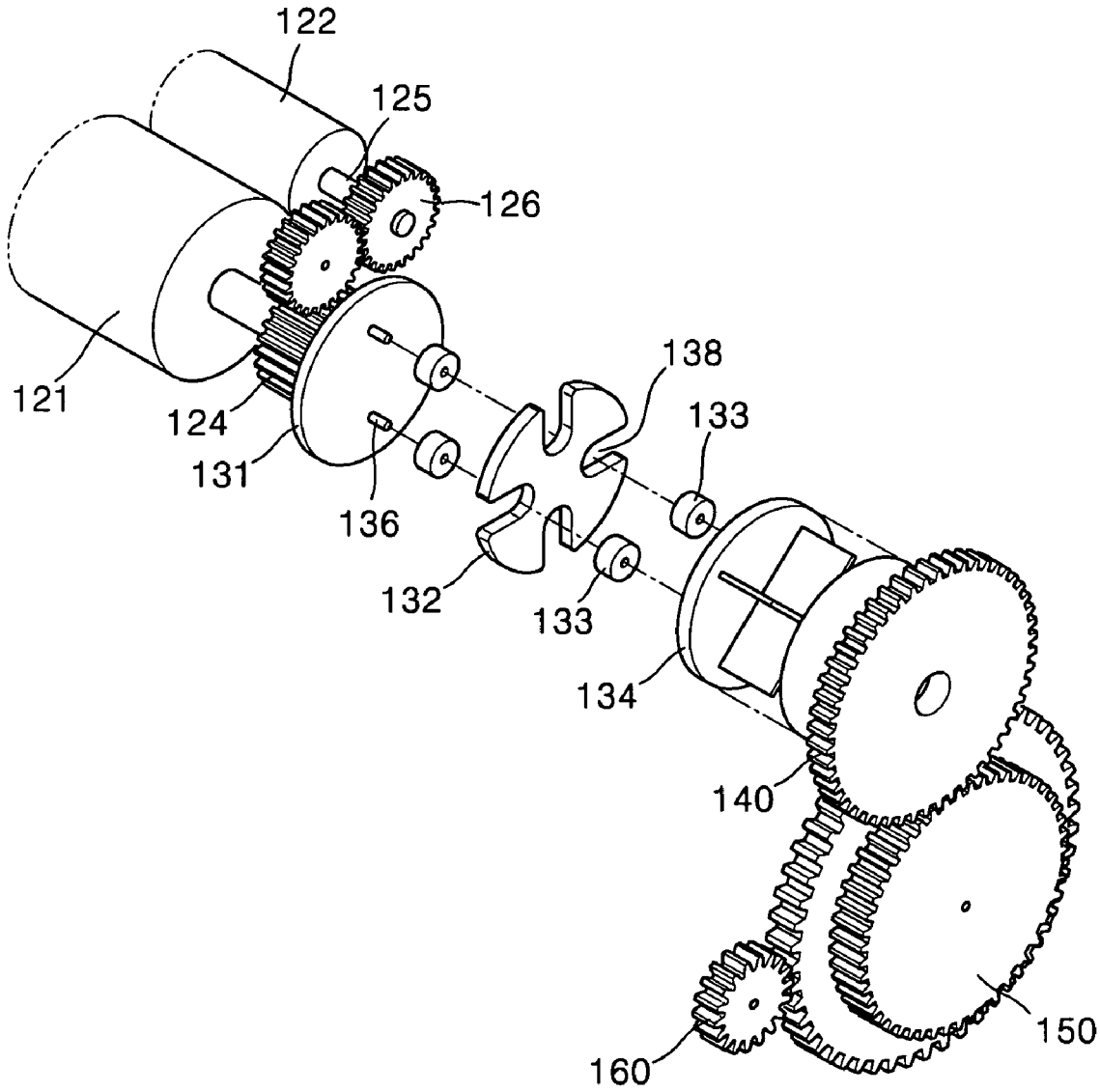
FIG. 4 (PRIOR ART)
FIG. 4 is an exploded perspective view illustrating a structure in which driving power is transferred from a motor pinion gear to the developing roller and a supply roller according to the conventional art.

Reference will now be made in detail to the embodiment of the present invention, an example of which is illustrated in the accompanying drawings, wherein like reference numerals refer to the like elements throughout. The embodiment is described below to explain the present invention by referring to the figures.

Figure 5:
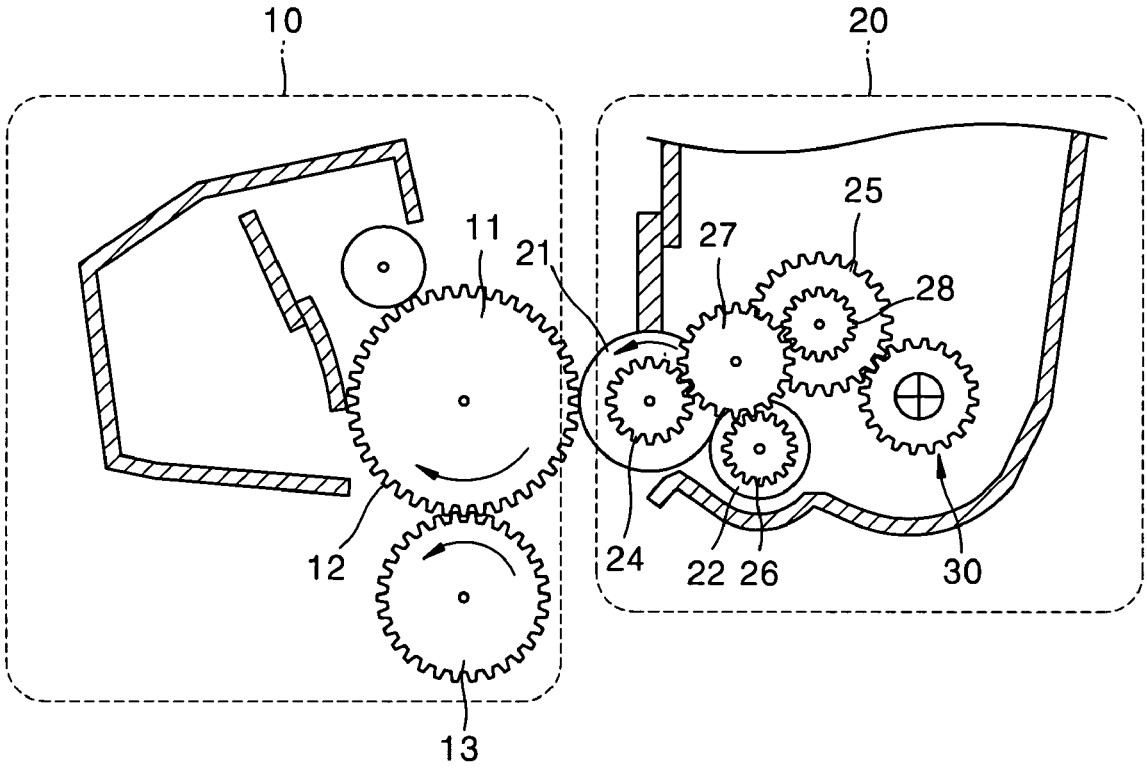
FIG. 5 is a diagram illustrating a structure of a detachable developing apparatus according to an embodiment of the present invention.

FIG. 5 schematically shows a detachable developing apparatus according to an embodiment of the present invention. A photosensitive unit 10 and a developing unit 20 are separately installed at a main body of a printer, copier or the like, and are separately driven by separate driving gears. In addition, in a state in which the photosensitive unit 10 is fixed to the main body, a photosensitive drum 11 of the photosensitive unit 10 and a developing roller 21 of the developing unit 20 come into contact with each other by pressing the developing unit 20 toward the photosensitive unit 10 with a force of a spring or the like. When driving power is transferred from a photosensitive-drum driving gear 13 to a photosensitive-drum gear 12, the photosensitive-drum gear 12 begins to rotate. Accordingly, as the photosensitive drum 11 joined to the photosensitive-drum gear 12 rotates, the photosensitive unit 10 begins to operate.

A conventional developing unit is designed so that after driving power of a motor pinion gear is transferred via a reduction gear, a driving gear, and a coupling member to a developing roller, a toner supply roller is rotated by an idle gear while the idle gear rotates according to the rotation of the developing roller. That is, external driving power is transferred to the developing roller first via the coupling member without speed reduction. Therefore, in the conventional developing unit, while a load applied to the coupling member increases, smooth operation of the coupling member is hindered.

Figure 6:
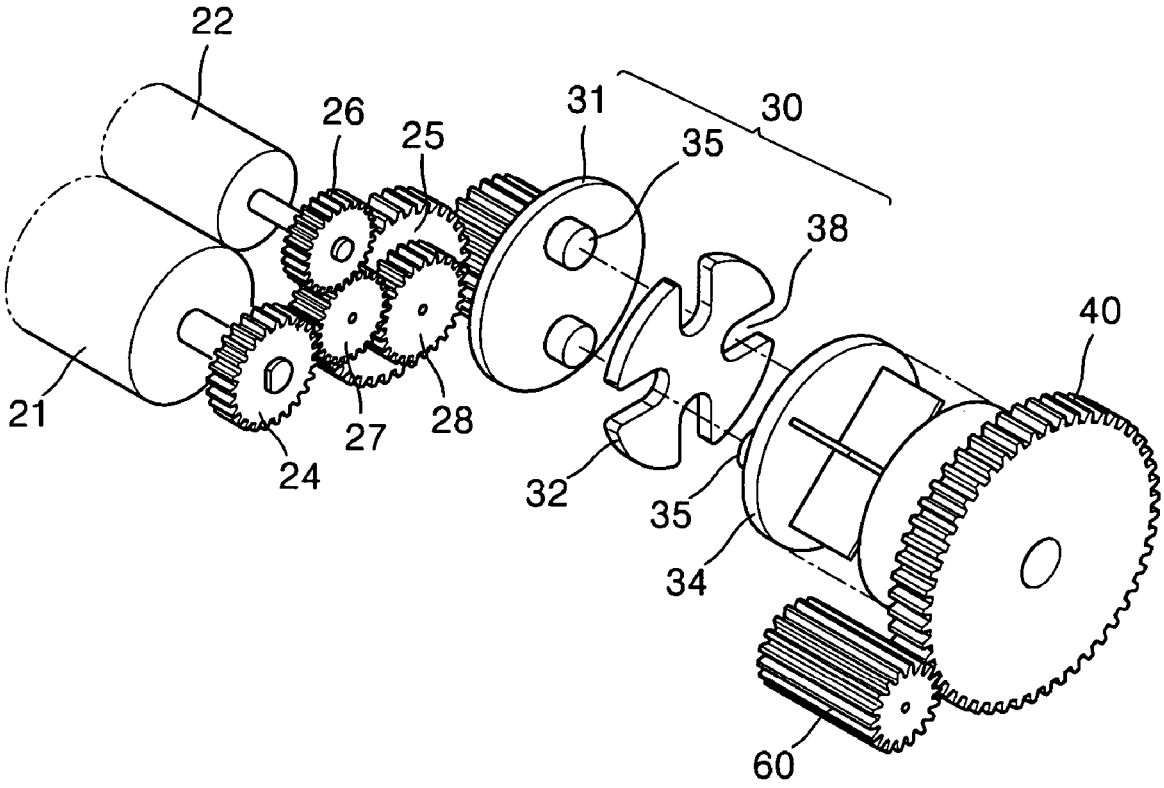
FIG. 6 is an exploded perspective view illustrating a structure of a coupling member and a structure in which driving power is transferred to a developing roller and a supply roller according to the embodiment of the present invention.

To the contrary, referring to FIG. 6, in the embodiment of the present invention, driving power of a motor pinion gear 60 is transferred to a driving gear 40, and driving power of the driving gear 40 is transferred to a reduction gear 25 via a coupling member 30 of an Oldham's coupling type joined to the driving gear 40. Thereafter, after the driving power is reduced in speed, the driving power is transferred via a first idle gear 27 to the developing roller 21 and a toner supply roller 22.

Here, in the reduction gear 25 joined to the coupling member 30, as shown in FIGS. 5 and 6, a second idle gear 28 which has a diameter and the number of teeth smaller than those of the reduction gear 25 is integrally formed. The second idle gear 28 rotates together with the reduction gear 25 around the shaft of the reduction gear 25, and transfers the driving power thereof to the developing roller 21 and the toner supply roller 22 while meshing with the first idle gear 27 and rotating.

Since the reduction gear 25 exists between the coupling member 30 and the developing roller 21 and the toner supply roller 22, the load applied from the developing roller 21 and the toner supply roller 22 to the coupling member 30 is markedly reduced. That is, in the conventional case, the load applied to the coupling member is the same as a value obtained by summing up the frictional loads of the developing roller and the toner supply roller. However, in the present invention, a resulting value of summing up the frictional loads of the developing roller 22 and the toner supply roller 21, and then dividing the summed value by the speed reduction ratio of the reduction gear 25 is the load applied to the coupling member 30. At this time, the speed reduction ratio of a series of gears joined to each other from the coupling member 30 to the developing roller 21 or the toner supply roller 22 must be greater than 1. In particular, for the purpose of achieving smooth operation of the coupling member 30, the speed reduction ratio may be greater than 1.5:1.

Figure 7A:
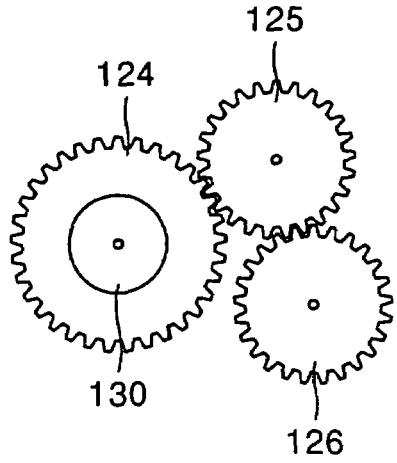
(PRIOR ART) FIG. 7A
FIGS. 7A and 7B are diagrams illustrating the effectiveness of the embodiment of the present invention as compared with the conventional art.
Figure 7B:
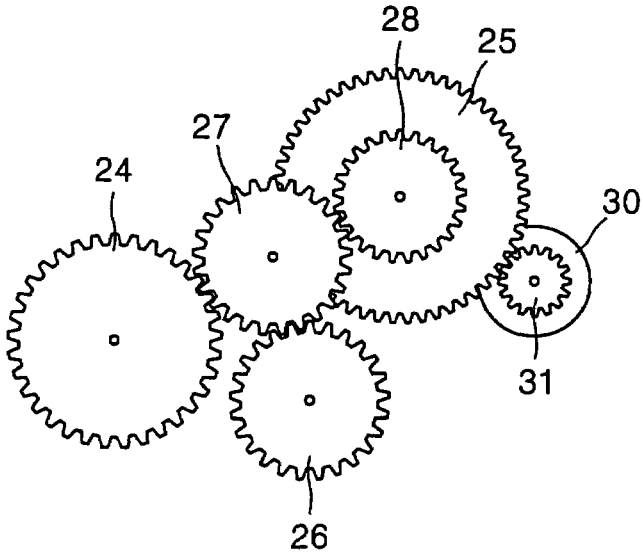

FIGS. 7A and 7B are diagrams exemplarily illustrating the effect of load reduction according to the conventional art and the embodiment of the present invention respectively. First, FIG. 7A exemplarily shows module values and the numbers of teeth of respective gears in a structure according to the conventional art. For example, as shown in FIG. 7A, it is assumed that the module of a developing roller gear 124 coaxially joined to the developing roller 121 is 0.6 and the number of teeth thereof is 26, the module of a supply gear 126 coaxially joined to the toner supply roller 122 is 0.6 and the number of teeth thereof is 21, and the module of the first idle gear 125 is 0.6 and the number of teeth thereof is 27. At this time, it is assumed that the frictional load Tdeve of the developing roller 121 is 1 kgf·cm, and the frictional load Tsr of the toner supply roller 122 is also 1 kgf·cm. Then, the load applied to the coupling member 130 is calculated as follows:

$$\text{load applied to the coupling member}=T_{deve}+T_{sr}\times(27/21)\times(26/27)=2.24\ \text{kgf·cm}$$

On the other hand, FIG. 7B exemplarily shows module values and the numbers of teeth of respective gears in a structure according to the embodiment of the present invention. For example, it is assumed that the module and the number of teeth of the developing roller gear 24, and the module and the number of teeth of a supply gear 26 have the same values as those of the conventional case, and the module of the reduction gear 25 is 0.4 and the number of teeth thereof is 64, and the module of the second idle gear 28 is 0.6 and the number of teeth thereof is 26. In addition, it is assumed that the module of a coupling gear 31 of the coupling member 30 which will be described below is 0.4 and the number of teeth thereof is 30. At this time, it is assumed that the frictional load Tdeve of the developing roller 21 and the frictional load Tsr of the toner supply roller 22 are also 1 kgf·cm as in the conventional case. Then, the load applied to the coupling member 30 of the present invention is calculated as follows:

$$\text{load applied to the coupling member}=Tdeve\times(27/26)+Tsr\times(27/21)\times(26/27)\times(30/64)=1.05\ \text{kgf·cm}$$

As described in the above examples, it can be found that, with the embodiment of the present invention, the load applied to the coupling member 30 is reduced to less than half of that of the conventional case. Therefore, as compared with the conventional coupling member 130, the coupling member 30 according to the embodiment of the present invention can be configured to have a simpler structure. That is, as previously described, in the conventional coupling member 130, in order to minimize the frictional load occurring in the sliding slots 138 due to the load applied to the coupling member 130, two pairs of the rotation shafts 136 are installed at the facing surfaces of the coupling gear 131 and the coupling drive 134 to project from the respective surfaces and to make an angle of 180° with each other on the respective surfaces, and sliding rollers 133 are fitted around the respective rotation shafts 136 so as to rotate in the sliding slots 138. However, since a respective smaller load is applied to the coupling member 30 according to the embodiment of the present invention, the coupling member 30 can be smoothly operated without the sliding rollers 133.

The structure of the coupling member 30 according to the embodiment of the present invention will be described with reference to FIG. 6 as follows. The coupling member 30 serves to transfer driving power to the developing unit 20 while being connected to the driving gear 40 and rotating together with the driving gear 40, and employs the Oldham's coupling mechanism capable of flexibly altering the center shaft so that eccentricity of the driving gear 40 due to tolerance occurring during manufacturing and assembly can be corrected. As shown in FIG. 6, the coupling member 30 includes a coupling drive 34 which is joined to the driving gear 40 and to which driving power is transferred from the driving gear 40, the coupling gear 31 which meshes with the reduction gear 25 and transfers the driving power transferred from the driving gear 40 to the reduction gear 25, and a coupling disc 32 which is positioned between the coupling drive 34 and the coupling gear 31 and flexibly connects the coupling drive 34 and the driving gear 31 to each other.

In order to perform the above functions, for example, four sliding slots 38 are formed at right angles with one another, i.e., equiangularly at the outer circumferential surface of the coupling disc 32. Here, the number of the sliding slots 38 is exemplary, and a greater number of sliding slots 38 may be formed according to a specific embodiment. In addition, two cylindrical sliding projections 35 are formed at the surface of the coupling drive 34 facing the coupling disc 32 to make an angle of 180° with each other, and the coupling drive 34 and the coupling disc 32 are joined to each other by inserting the sliding projections 35 into the sliding slots 38. In addition, two cylindrical sliding projections 35 are also formed at the surface of the coupling gear 31 facing the coupling disc 32 to make an angle of 180° with each other, and the coupling gear 31 and the coupling disc 32 are joined to each other by inserting the sliding projections 35 into the remaining sliding slots 38. At this time, the sliding projections 35 formed at the coupling drive 34 and the sliding projections 35 formed at the coupling gear 31 are alternately inserted into the sliding slots 38 of the coupling disc 32. With such a connection, the coupling member 30 can smoothly transfer the driving power to the reduction gear 25 whether or not an eccentricity exists between the connected shafts.

Since the load applied to the coupling member 30 is markedly reduced as compared with that of the conventional design, friction between the sliding projections 35 and the sliding slots 38 can be sufficiently reduced even without the conventional sliding rollers, and, accordingly, as compared with the conventional design, the coupling member 30 can secure smooth operation even with a simple structure, and vibration is correspondingly dampened.

With the present invention, since the Oldham's coupling member is connected to the developing roller and the like by an element of the reduction gear, the load applied to the coupling member can be minimized. Therefore, since friction occurring at the sliding slots of the coupling member can be reduced, the coupling member can be simply structured without using relatively complex members such as rollers. Thus, since the manufacturing process thereof can be reduced, and material costs and the like can be cut down, there is an advantage in which the manufacturing cost of the developing apparatus can be reduced.

Further, since the load applied to the coupling member is relatively small, the function of correcting eccentricity occurring at the shaft is achieved, and the nip depth between the photosensitive drum and the developing roller of the developing apparatus can always be maintained uniformly. Therefore, enhancement of image quality of the developing apparatus can be achieved.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A driving apparatus of a detachable developing apparatus to transfer driving power of a driving element of the developing apparatus to a developing element, comprising:

a shaft;

a coupling member comprising:

a coupling drive which is connected to the driving element and to which the driving power is transferred from the driving element, a coupling gear to which the driving power is transferred from the coupling drive, and a coupling disc positioned between the coupling drive and the coupling gear to flexibly connect the coupling drive and the coupling gear to each other, and correcting an eccentricity of the shaft between the driving element and the coupling gear; and a power transferring portion including a plurality of gears so as to transfer the driving power from the coupling member to the developing element, wherein at least one of the plurality of gears is a reduction gear to reduce a load applied to the coupling member from the developing element, and a speed reduction ratio between the developing element and the coupling member is greater than 1:1, a rotation speed of the coupling member is higher than a rotation speed of the developing element, and a torsional moment applied to the coupling member is smaller than a torsional moment applied to the developing element.

2. The driving apparatus of a detachable developing apparatus according to claim 1, further comprising four sliding slots formed at right angles with one another at an outer circumferential surface of the coupling disc.

3. The driving apparatus of a detachable developing apparatus according to claim 2, further comprising two pairs of sliding projections formed at respective surfaces of the coupling drive and the coupling gear which face the coupling disc to make an angle of 180° with each other on the respective surfaces, wherein the pair of sliding projections of the coupling drive and the pair of sliding projections of the coupling gear are alternately inserted into the sliding slots of the coupling disc.

4. The driving apparatus of a detachable developing apparatus according to claim 3, wherein the sliding projections have a cylindrical shape.

5. The driving apparatus of a detachable developing apparatus according to claim 1, wherein the reduction gear includes a first gear meshed with the coupling gear, and a second gear integrally formed with the first gear, the first and second gears comprising respective sets of teeth, the first gear and the second gear have a common rotation shaft, and a number of teeth of the second gear is smaller than a number of teeth of the first gear.

6. The driving apparatus of a detachable developing apparatus according to claim 5, wherein the power transferring portion further includes idle gears which transfer the driving power to the developing element while meshing with the second gear and rotating.

7. The driving apparatus of a detachable developing apparatus according to claim 1, wherein the power transferring portion transfers the driving power of the driving element to a toner supply element of the developing apparatus.

8. A driving apparatus of a detachable developing apparatus to transfer driving power of a driving element of the developing apparatus to a developing element, comprising:

a shaft;

a coupling member comprising:

a coupling drive which is connected to the driving element and to which the driving power is transferred from the driving element, a coupling gear to which the driving power is transferred from the coupling drive, and a coupling disc positioned between the coupling drive and the coupling gear to flexibly connect the coupling drive and the coupling gear to each other, and correcting an eccentricity of the shaft between the driving element and the coupling gear;

a power transferring portion including a plurality of gears so as to transfer the driving power from the coupling member to the developing element, wherein at least one of the plurality of gears is a reduction gear to reduce a load applied to the coupling member from the developing element; and a series of gears connected from the coupling member to the developing element, wherein a speed reduction ratio of the series of gears is greater than 1.5:1.

9. A driving apparatus of a developing apparatus to transfer a driving power of a driving element of the developing apparatus to a developing element of the developing apparatus comprising a shaft, the driving apparatus comprising:

a coupling member which is connected to the driving element and to which the driving power is transferred from the driving element, and correcting an eccentricity of the shaft between the driving element and the coupling member; and a power transferring portion including a plurality of gears so as to transfer the driving power from the coupling member to the developing element, wherein at least one of the plurality of gears is a reduction gear to reduce a load applied to the coupling member from the developing element, and a speed reduction ratio between the developing element and the coupling member is greater than 1:1, a rotation speed of the coupling member is higher than a rotation speed of the developing element, and a torsional moment applied to the coupling member is smaller than a torsional moment applied to the developing element.

10. A detachable developing apparatus, comprising:

a shaft;

a photosensitive unit, an electrostatic image being formed thereon by being exposed to a laser;

a developing unit to form a toner image from the electrostatic image by supplying toner to the photosensitive unit;

a driving unit to transfer a driving power supplied to the developing unit;

a toner supply unit to supply the toner to the developing unit;

a coupling member comprising:

a coupling drive connected to the driving unit and to which the driving power is transferred from the driving unit, a coupling gear to which the driving power is transferred from the coupling drive, and a coupling disc positioned between the coupling drive and the coupling gear to flexibly connect the coupling drive and the coupling gear to each other, and to correct an eccentricity of the shaft between the driving unit and the coupling gear; and a power transferring unit comprising a plurality of gears to reduce the driving power from the coupling member to the developing unit, a speed reduction ratio between the developing unit and the coupling member being greater than 1:1, a rotation speed of the coupling member is higher than a rotation speed of the developing element, and a torsional moment applied to the coupling member is smaller than a torsional moment applied to the developing element.

11. A detachable developing apparatus comprising:

a developer unit to develop an electrostatic image with a toner;

a driving unit to transfer a driving power supplied to the developing unit;

a coupling unit to receive the driving force, wherein the coupling unit comprises an Oldham's coupling mechanism; and a reduction gear to reduce the received driving force and transfer the reduced driving force to the developer unit, a speed reduction ratio between the developer unit and the coupling unit being greater than 1:1, a rotation speed of the coupling member is higher than a rotation speed of the developing element, and a torsional moment applied to the coupling member is smaller than a torsional moment applied to the developing element.

12. The developing apparatus of claim 11, further comprising a toner supply unit to supply the toner to the developer unit, wherein the reduced driving force is received by the toner supply unit.

13. The developing apparatus of claim 11, wherein the coupling unit comprises a disc having a plurality of slots at an outer circumferential surface thereof.

14. The developing apparatus of claim 13, wherein the coupling unit further comprises a drive to receive the driving force and comprising a projection inserted into one of the slots of the disc.

15. The developing apparatus of claim 13, wherein the coupling unit further comprises a gear to transfer the driving force to the developer unit and comprising a projection inserted into one of the slots of the disc.

16. The developing apparatus of claim 11, further comprising a driving gear to supply the driving force to the coupling unit, wherein the coupling unit corrects an eccentricity of the driving gear.

17. The developing apparatus of claim 16, wherein the coupling unit rotates with the driving gear.

18. A detachable developing apparatus comprising:

a developer unit to develop an electrostatic image with a toner;

a coupling unit to receive a driving force; and a reduction gear to reduce the received driving force and transfer the reduced driving force to the developer unit, wherein a speed reduction ratio of the reduction gear is 1.5:1 or greater.

* * * * *